United States Patent [19]

Itoh

[11] 4,352,176

[45] Sep. 28, 1982

[54] ELECTROMAGNETIC PICKUP CARTRIDGE

[75] Inventor: Masashi Itoh, Settsu, Japan

[73] Assignee: Matsushita Electric Industrial Co., Ltd., Osaka, Japan

[21] Appl. No.: 216,868

[22] Filed: Dec. 16, 1980

[30] Foreign Application Priority Data

Dec. 19, 1979 [JP] Japan ..... 54/165875
Feb. 6, 1980 [JP] Japan ..... 55/14601[U]

[51] Int. Cl.[3] ..... H04R 11/12
[52] U.S. Cl. ..... 369/170; 369/139; 369/149
[58] Field of Search ..... 369/170, 172, 146, 148, 369/149, 135, 139, 171

[56] References Cited

U.S. PATENT DOCUMENTS 3,761,647 9/1973 Nemoto et al. ..... 369/170
3,904,837 9/1975 Sugimoto et al. ..... 369/170

*Primary Examiner*—Steven L. Stephan
*Attorney, Agent, or Firm*—Burgess, Ryan and Wayne

[57] ABSTRACT

An electromagnetic pickup cartridge in which a cantilever with a stylus tip at the free end thereof is extended perpendicularly from the center of one major surface of an armature which is partially embedded in a holder which is made of a high molecular weight compound, which serves as a suspension part and in turn is mounted through a damper in a sleeve. Since the armature is not needed to be formed with a center aperture, the fabrication cost can be reduced.

5 Claims, 16 Drawing Figures

ELECTROMAGNETIC PICKUP CARTRIDGE

BACKGROUND OF THE INVENTION

The present invention relates to an electromagnetic pickup cartridge such as a moving-magnet or moving-iron pickup cartridge.

In the reproduction of the 45/45-degree-groove stereophonic disks, the electromagnetic pickup cartridges have been widely used because of their high performance and the ease with which a stylus is replaced. Of the electromagnetic pickup cartridges, the moving-magnet pickup cartridges are especially preferred and the moving-iron pickup cartridges are also used. In order to improve the performance of the electromagnetic pickup cartridges, the improvements of a vibration system consisting of a stylus, a cantilever, an armature and a damper must be made so that the stylus velocity can be faithfully transmitted. At the same time, it is also essential to reduce not only the variations in performance of the pickup cartridges but also the fabrication costs thereof.

The magnets used in the vibration systems of electromagnetic pickup cartridges are very small yet have a high permeability because they are made of rare-earth magnetic materials. In general, the prior art magnets are circular in shape and must be formed with a center aperture, but fabricability of such magnetic materials as described above is poor, so that the fabrication costs are high.

SUMMARY OF THE INVENTION

In view of the above, the primary object of the present invention is to provide an electromagnetic pickup cartridge in which an armature such as a moving-magnet or moving-iron, does not require a center aperture for mounting a cantilever so that the armatures can be fabricated in a simple manner at less costs and yet high performance can be ensured.

According to the present invention, a cantilever with a stylus tip at the free end thereof is extened perpendicularly from the center of one major surface of an armature which is flat and very simple in shape. The armature is partially embedded in a holder which is made of a high molecular weight compound and serves as a suspension thread; that is, is integral with a suspension thread part. The armature unit or the vibration system consisting of the cantilever and the holder with the armature embedded therein in turn is mounted in a sleeve through a damper.

The above and other objects, effects and features of the present invention become more apparent from the following description of some preferred embodiments thereof taken in conjunction with the accompanying drawings thereof.

DETAILED DESCRIPTION OF THE PRIOR ART

Figure 1:
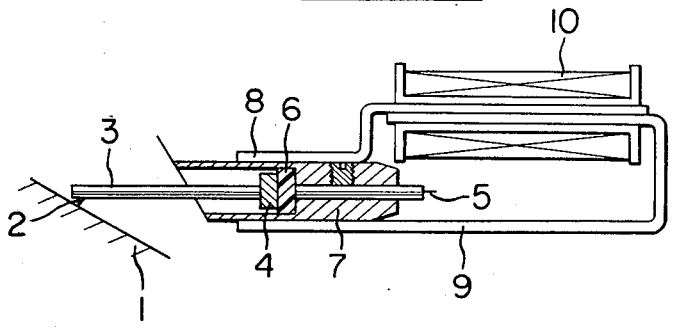
FIG. 1 PRIOR ART
FIG. 1 is a sectional view of a prior art electromagnetic pickup device.

FIG. 1 shows a fundamental form of electromagnetic pickup cartridges. A stylus tip 2, which contacts the groove of a disk 1, is securely fixed to the free end of a cantilever 3 which in turn is supported by a ring magnet 4 having a center aperture. Extended from the center of the ring magnet 4 is a suspension or drag wire or thread 5 of a high molecular weight compound which in turn is held through a damper 6 made of rubber or the like in a sleeve 7 made of a nonmagnetic material. In response to the vibrations of the stylus tip 2, the ring magnet 4, which is magnetized in the axial direction of the cantilever 3, vibrates so that the variations in magnetic fluxes are transmitted to a yoke consisting of yoke parts 8 and 9 and consequently an output voltage is developed across a coil 10 mounted on the yoke.

Figure 2:
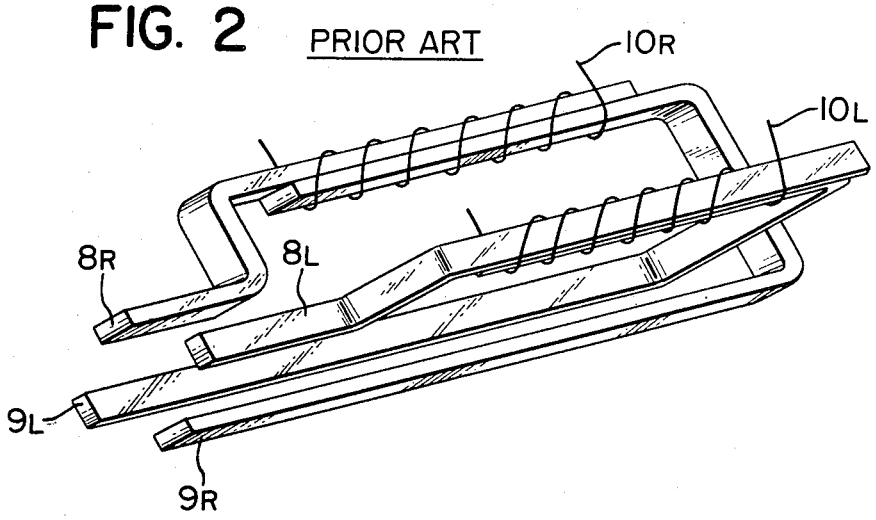
FIG. 2 PRIOR ART
FIG. 2 is a perspective view of a yoke assembly thereof.
Figure 3:
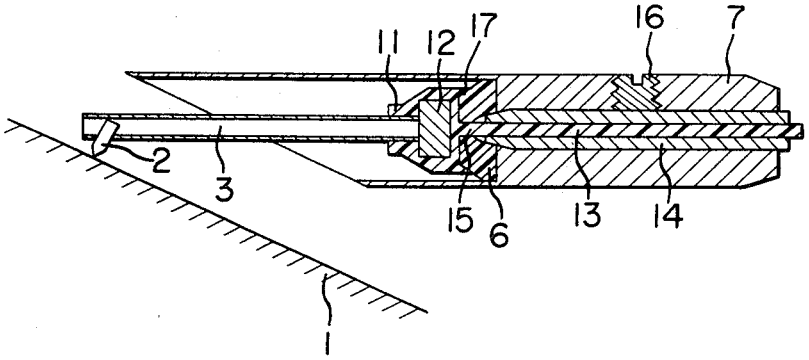
FIG. 3 is a sectional view of a first embodiment of the present invention.

In the case of a stereophonic pickup cartridge, as shown in FIG. 2, the right channel yoke consisting of yoke parts 8R and 9R and the right channel coil 10R are disposed along the axis of the maximum sensitivity for the right channel. In like manner, the left channel yoke consisting of yoke parts 8L and 9L and the left channel coil 10L are disposed along the axis of the maximum sensitivity for the left channel.

With the electromagnetic pickup cartridges of the types described above, the magnet 4 is in general circular in shape and is formed with a center aperture. The prior art electromagnetic pickup cartridges, therefore, have the problems (1) that the disk-shaped magnets cannot be fabricated with a satisfactory degree of dimensional accuracy and (2) that since a center aperture must be formed through the ring magnets, the fabrication costs become high.

DESCRIPTION OF THE PREFERRED EMBODIMENTS

First Embodiment, FIGS. 3 through 8

The stylus tip 2 is securely fixed to the outer end of the cantilever which is solid or hollow and is made of light yet strong metals such as aluminum, titanium, boron, etc. or high molecular weight compounds. The inner end of the cantilever 3 is securely joined to the center of the outer surface of a rectangular magnet 12. The cantilever 3 and the magnet 12 are disposed within a holder 11 made of high molecular weight compounds such as nylon, duracon, and the like. A suspension thread 13, which corresponds to the suspension wire 5 shown in FIG. 1, is extended from the center of the inner surface of the magnet 12. More specifically, the cantilever 3, the magnet holder 11 and the suspension thread 13 are molded as a unit with the magnet 12 inserted or embedded in the holder 11. A reinforcing pipe 14 is fitted over the suspension thread 13. An imaginary pivot point 15 is determined between the outer end of the pipe 14 and the inner surface of the magnet 12. The rear end of the suspension thread 13 is fused and joined to a sleeve through a damper 6 and a pipe 14. The subassembly consisting of the cantilever 3, the magnet holder 11 with the magnet 12 and the suspension thread 13 with the pipe 14 fitted thereover is mounted on a sleeve 7 through a damper 6 with a setscrew 16 in such a way that a suitable damping force may be exerted on the pipe 14 and hence on the suspension thread 13. The inner end face of the magnet holder 11 is recessed as if it were countersunk as shown at 17 so that the holder 11 may snugly mate with the damper 6 and may be correctly aligned therewith in the axial direction. As a result, the assembly can be readily accomplished. In addition, satisfactory damping effects can be attained by the engagement of the damper 6 with the rim or flange of the recess 17.

According to the first embodiment, it is not necessary to form a center aperture through the square magnet 12. Furthermore, the fabrication of the rectangular magnets is far easier than that of the circular or ring magnets. Thus, the fabrication costs can be considerably reduced.

Figure 4:
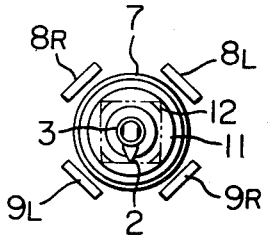
FIG. 4 is an end view thereof.
Figure 7:
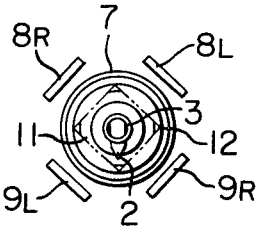
FIG. 7 shows a modification of an arrangement of the vibration system or the armature unit with respect to the yoke assembly.
Figure 5:
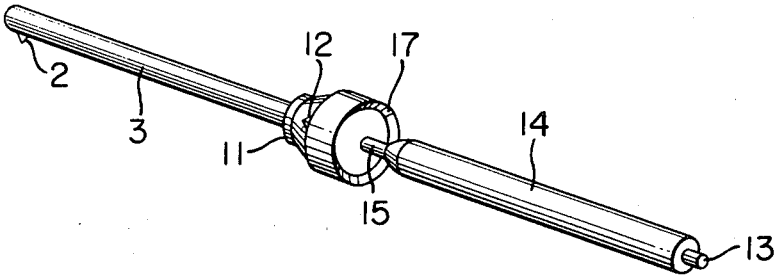
FIG. 5 is a perspective view of a vibration system or an armature unit thereof.

As shown in FIG. 4, the sleeve 7 is assembled with the yoke parts 8L, 8R, 9L and 9R in such a way that the vertices of the square magnet 12 are positioned in opposed relationship with the parts 8R, 8L, 9R and 9L. In this case, the output is substantially equal to that derived from the pickup cartridge of the type having the ring or circular magnet 4 as shown in FIG. 1. In addition, no yoke part is located vertically and horizontally of the sleeve 7 or the square magnet 12 so that the adverse effects in the vertical and horizontal directions are eliminated even when the magnet 12 is reduced in mass. When the magnet 12 is reduced in mass, the vibration characteristics can be improved. Alternatively, as shown in FIG. 7, the square magnet 12 may be so disposed with respect to the yoke assembly that one pair of opposite vertices of the magnet 12 are located on the vertical line while another pair of opposite vertices are located on the horizontal line and these vertices and the yoke parts are symmetrical about the center of the square magnet 12. In this case, the same performance as that obtained when the magnet 12 is arranged as shown in FIG. 4 can be ensured.

Figure 8:
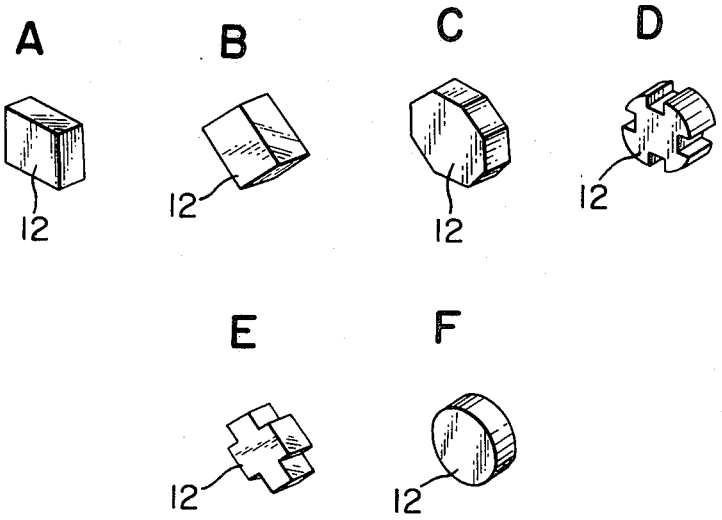
FIGS. 8A–8F show various types of armatures used in the present invention.
Figure 6:
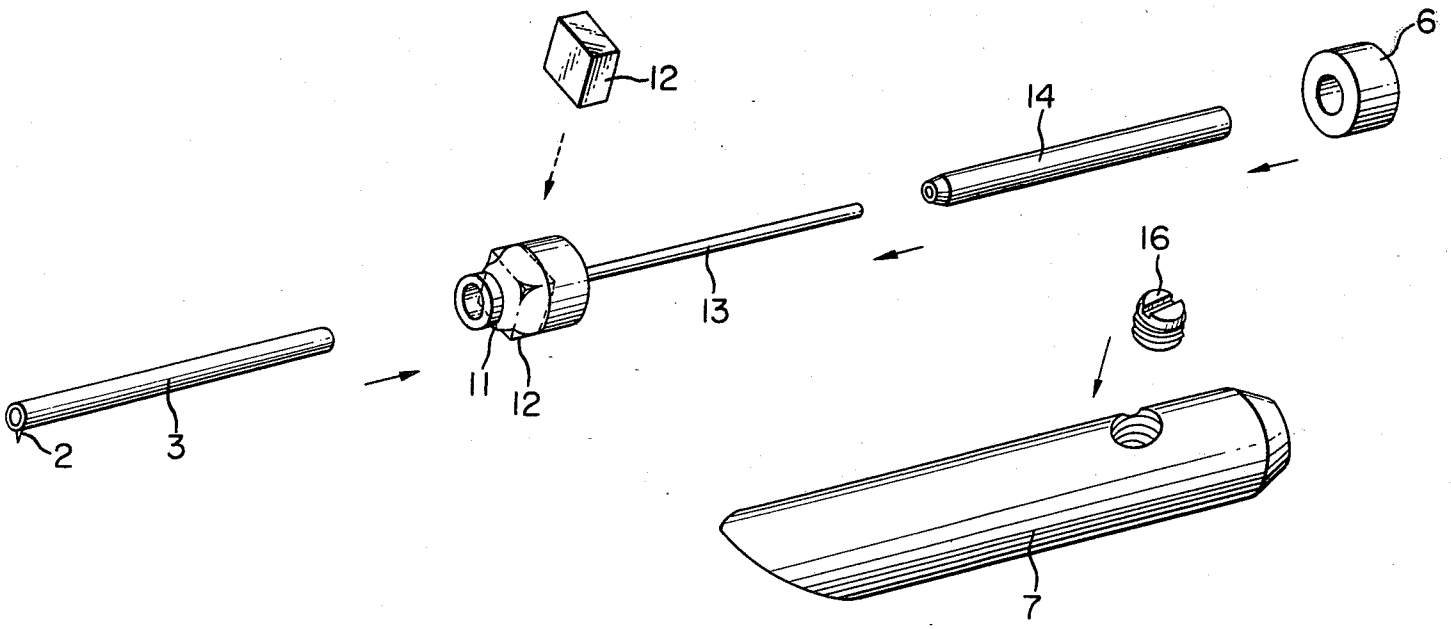
FIG. 6 is an exploded perspective view of the vibration system or the armature unit.

FIG. 8 shows magnets in various shapes which can be used in the first embodiment instead of the square magnet 12. None of the magnets need be formed with a center aperture so that they can be fabricated at less cost.

In the prior art pickup cartridges, adhesive agents are widely used in order to bond the parts of the pickup cartridges such as suspension wires, magnets, cantilevers and so on, so that variations in dimensional accuracy result. However, according to the first embodiment of the present invention, the cantilever 3, the magnet holder 11 and the suspension thread 13 can be molded in one step as a unitary construction with the magnet 12 embedded in the holder 11, so that dimensional variations can be reduced to a minimum. In addition, the recess 17 at the inner surface of the magnet holder 11 can be varied in shape arbitrarily so that various damping effects may be attained. More specifically, the desired pickup cartridge characteristics vary depending upon the materials selected for cantilevers and other parts. However, departure from the desired characteristics can be compensated for by selecting a suitable recess for receiving the damper. The recess 17 can be of course eliminated.

So far the cantilever 3 has been described as being molded in unison with the magnet holder 11 and the suspension thread 13, but it is to be understood that the cantilever 3 can be fabricated independently of the magnet holder 11 and bonded thereto with a suitable adhesive or joined thereto when the holder 11 is molded. In the former case, the inner end face of the cantilever 3 must be roughened and then cleaned thoroughly, so that a higher degree of adhesive strength can be attained. In the latter case, it is preferable that the cantilever 3 be hollow so that when the holder 11 is molded, a liquid resin may flow into the hollow cantilever 3, whereby the strong joint between them can be ensured.

So far the first embodiment of the present invention has been described in detail in conjunction with the moving-magnet pickup cartridge, but it is to be understood that the present invention may be equally applied to the moving-iron pickup cartridges. In the latter case, instead of the magnet 12, an armature made of magnetic material such as permalloy is used.

Figure 9:
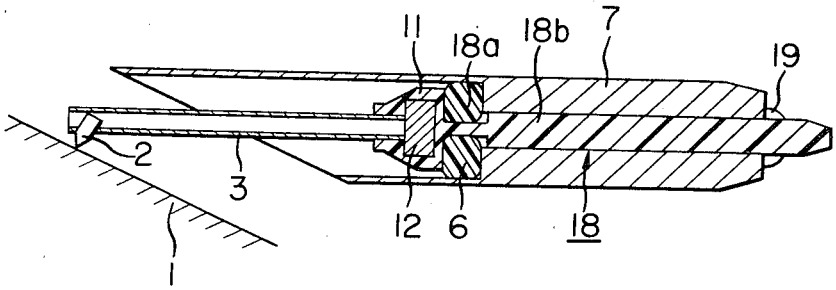
FIG. 9 is a sectional view of a second embodiment of the present invention.
Figure 10:
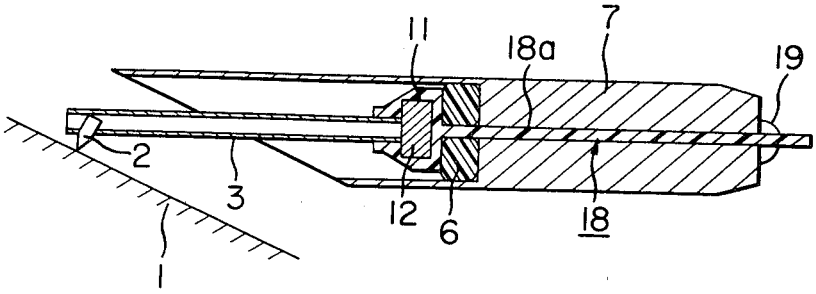
FIGS. 10 and 11 show two modifications thereof, respectively.
Figure 11:
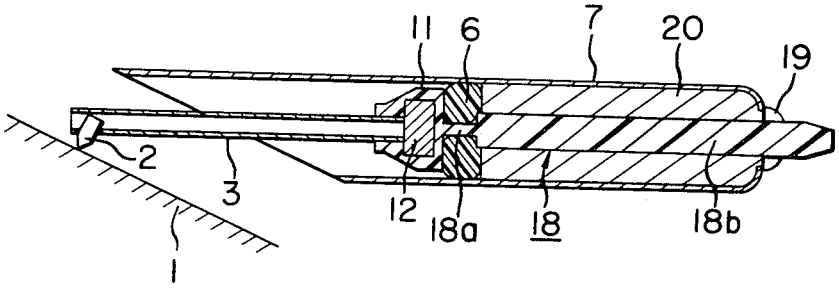

Second Embodiment, FIGS. 9 through 11

In the first embodiment, the rear suspension part consists of the suspension thread 13 and the reinforcing or suspension pipe 14. This rear suspension part may be fabricated separately and joined to the magnet holder 11 when the latter is molded.

Alternatively, in the second embodiment, the rear suspension part generally indicated by the reference numeral 18 consists of a small-diameter suspension thread portion **18*a* and a large-diameter suspension thread portion 18*b* and is molded integral with the magnet holder 11. The subassembly consisting of the cantilever 3, the magnet holder 11 with the magnet 12 embedded therein and the rear suspension part 18 is mounted on a sleeve 7, which is made of a non-magnetic material, through a damper 6 in such a way that the large diameter portion 18*b* of the rear suspension part 18 is inserted into an axial hole of the sleeve 7 and the rear end of the large-diameter portion 18*b* is extended out of the axial hole as shown in FIG. 9 when the holder 11 is pressed against the damper 6 so as to compress it to a suitable degree. The extended portin of the large diameter portion is thermoplastically deformed so as to form a stopper 19**. The sub-assembly of the second embodiment is advantageous in that it can be molded in one step so that the variations in dimensional accuracy can be reduced to a minimum and the fabrication cost can be lowered.

FIG. 10 shows a modification of the second embodiment. The rear suspension part 18 consists only of the small-diameter portion **18*a* which in turn is inserted into a mating axial hole of the sleeve 7**.

FIG. 11 shows another modification of the second embodiment. The large-diameter portion **18*b* of the rear suspension part 18 is inserted into an axial hole of an inner sleeve 20 which in turn is inserted into the sleeve 7 and is made of a non-magnetic material such as a synthetic resin. The portion of the large-diameter portion 18*b* extended out of the inner sleeve 20 is thermoplastic welded to the sleeve 20 so that the stopper 19** may be increased in mechanical strength.

What is claimed is:

1. An electromagnetic pickup cartridge having a vibration system wherein the vibration system comprises: a flat centerholeless armature symmetrical about its centerline and having opposite first and second major surfaces; a cantilever extended perpendicularly from the center of the first major surface of said flat armature provided with a stylus tip near the free end; an armature holder made of a high molecular weight resin molded to cover all the surfaces of the armature and the end of the cantilever adjacent the first major surface of the armature; a suspension thread, integral with the armature holder, extends perpendicularly to the center of the second major surface of said flat armature; a damper made of elastic material in contact with the armature holder, said armature holder being maintained in contact with the damper by means of the suspension thread extending through the damper and a sleeve.

2. An electromagnetic pickup cartridge of claim 1 wherein the armature holder has a recess with a circular rim to engage said damper, which is pressed against said recess of said holder, whereby said damper is correctly positioned by said circular rim and damping effects can be attained.

3. An electromagnetic pickup cartridge of claim 1 or 2 wherein said damper is maintained in contact with said armature holder by tension in said suspension thread which extends through said damper, and said sleeve and wherein said tension in said suspension thread is provided by compression of the damper between said armature holder and said sleeve and the end of said suspension thread extending from said sleeve is deformed while the damper is compressed.

4. An electromagnetic pickup cartridge of claim 1 or 2 wherein said suspension thread extends through a pipe inserted in said sleeve.

5. An electromagnetic piickup cartridge of claim 3 wherein said suspension thread extends through a pipe inserted in said sleeve.

* * * * *